US010907931B2

(12) United States Patent
Schoenborn et al.

(10) Patent No.: US 10,907,931 B2
(45) Date of Patent: Feb. 2, 2021

(54) DEVICE FOR ADJUSTING THE ORIENTATION OF A REAR STOCK OF A PORTABLE FIREARM

(71) Applicant: Damian Schoenborn, Goellersdorf (AT)

(72) Inventors: Damian Schoenborn, Goellersdorf (AT); Martin Kronsteiner, Vienna (AT)

(73) Assignee: Damian Schoenborn, Goellersdorf (AT)

( * ) Notice: Subject to any disclaimer, the term of this patent is extended or adjusted under 35 U.S.C. 154(b) by 0 days.

(21) Appl. No.: 16/628,657

(22) PCT Filed: Jul. 5, 2018

(86) PCT No.: PCT/AT2018/060136

§ 371 (c)(1),
(2) Date: Jan. 3, 2020

(87) PCT Pub. No.: WO2019/006486

PCT Pub. Date: Jan. 10, 2019

(65) Prior Publication Data

US 2020/0149840 A1 May 14, 2020

(30) Foreign Application Priority Data

Jul. 5, 2017 (AT) ..... A 50557/2017

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/14; F41C 23/04
See application file for complete search history.

(56) References Cited

U.S. PATENT DOCUMENTS 1,468,354 A 9/1923 Caretto
4,300,302 A * 11/1981 Anschutz ..... F41C 23/14 42/73
2013/0000175 A1 1/2013 Quaedpeerds et al.

FOREIGN PATENT DOCUMENTS

DE 63761 c 8/1892
DE 413323 C 5/1925
(Continued)

OTHER PUBLICATIONS

ISA European Patent Office, International Search Report Issued in Application No. PCT/AT2018/060136, dated Sep. 20, 2018, WIPO, 3 pages.

*Primary Examiner* — Joshua T Semick
(74) *Attorney, Agent, or Firm* — McCoy Russell LLP

(57) ABSTRACT

The invention relates to a device for adjusting the orientation of a rear stock of a portable firearm relative to a barrel of the portable firearm, comprising a ball joint, which is arranged between the rear stock and a front part fixedly connected to the barrel and which has a first joint part connected in a positionally fixed manner to the front part or the rear stock and a second joint part, which can be pivoted relative to the first joint part and which is connected in a positionally fixed manner to the other of the rear stock or the front part, wherein the first joint part and the second joint part are connected to each other in a pivotable and fixable manner by means of a releasable and fixable fixing apparatus, the fixing apparatus has at least one fixing element, the first joint part has a spherical, in particular ball-shaped, joint head, which is mounted in a corresponding recess of the second joint part, the fixing apparatus has a clamping part, which likewise has a recess for at least partly receiving the spherical joint head, and, in the fixed state, the joint head is clamped between the second joint part and the clamping part by means of the at least one fixing element.

9 Claims, 1 Drawing Sheet

(56) References Cited

FOREIGN PATENT DOCUMENTS

| | | | | |
|---|---|---|---|---|
| DE | 3631391 | A1 * | 3/1988 | ..... F41C 23/14 |
| DE | 3631391 | A1 | 3/1988 | |
| EP | 2541188 | A1 | 1/2013 | |
| FR | 2274885 | A1 | 1/1976 | |
| GB | 24995 | A | 2/1900 | |

* cited by examiner

DEVICE FOR ADJUSTING THE ORIENTATION OF A REAR STOCK OF A PORTABLE FIREARM

CROSS-REFERENCE TO RELATED APPLICATIONS

The present application is a U.S. National Phase of International Patent Application Serial No. PCT/AT2018/060136 entitled "DEVICE FOR ADJUSTING THE ORIENTATION OF A REAR STOCK OF A PORTABLE FIREARM," filed on Jul. 5, 2018. International Patent Application Serial No. PCT/AT2018/060136 claims priority to Austrian Patent Application No. A 50557/2017 filed on Jul. 5, 2017. The entire contents of each of the above-referenced applications are hereby incorporated by reference for all purposes.

TECHNICAL FIELD

The invention relates to a device for adjusting the orientation of a rear stock of a handgun, in particular of a long firearm, relative to a barrel of the handgun, comprising a ball joint, which is arranged between the rear stock and a front part fixedly connected to the barrel which ball joint comprises a first joint part connected in a positionally fixed manner to the front part or the rear stock, and a second joint part, which can be pivoted relative to the first joint part and which is connected in a positionally fixed manner to the other of the rear stock or the front part, wherein the first joint part and the second joint part are connected to one another by means of a fixing apparatus so as to be pivotable and rotatable with respect to one another in a released state of the fixing apparatus, and so as to be fixed with respect to one another in their adjusted positions in a fixed state of the fixing apparatus, and the fixing apparatus comprises at least one fixing element for releasing and fixing the fixing apparatus.

BACKGROUND AND SUMMARY

Adjusting devices of this type provide for an individual adaptation of the orientation of a front part of the firearm in relation to a rear stock of the firearm to the needs of a shooter and thus facilitate the handling of the firearm, both while aiming at a target and during the subsequent firing of a shot. In connection with this invention, front part is to be understood as the remaining part of the firearm, which is not fixedly connected to the rear stock or which does not belong to the rear stock, respectively, and which comprises the barrel or which is fixedly connected to the barrel, respectively. Adjusting devices comprising a ball joint thereby offer particularly diverse adjusting options for the orientation of the barrel with respect to the rear stock.

U.S. Pat. No. 2,631,398 discloses a hunting rifle, the rear stock of which can be adjusted relative to the line of sight of the hunting rifle. For this purpose, a rod, which passes through the rear stock and connects the latter to a handle part, can be pivoted about a rotation point of the handle part by means of a ball joint. On the end facing the rear stock, the handle part comprises a convex spherical surface, on which a front side of a disk abuts, which front side is formed so as to correspond to the convex spherical surface and which disk is received on the rod between the handle part and the rear stock. To fix the rod in the desired position in relation to the handle part, a nut and a counter nut are screwed to a threaded part of the rod and push the disk against the handle part in response to corresponding screw connection.

In an alternative design, the rod runs through a conical hole in the rear stock and is fixedly connected to the handle part. In the area of its end facing the handle part, the rod comprises a spherical widening and is connected on the opposite end to an eccentric block, which is arranged in the rear stock so as to be rotatable around the rod. The rear stock is adjusted by rotation of the eccentric block and is fixed in the adjusted position by means of a screw.

Disadvantageously, the rod for orientation of the rear stock relative to the line of sight of the hunting rifle runs through the rear stock of the hunting rifle, so that this design is only suitable for firearms comprising a corresponding receiving space for the rod in the rear stock.

It is now the object of the invention to create an adjusting device, as specified above, which avoids or at least reduces the disadvantages of the prior art. The adjusting device is to also be suitable for firearms, which do not provide a receiving space for a rod passing through the rear stock or for other adjusting means and/or fixing means passing through the rear stock. This relates in particular to firearms, in the rear stock of which recoil-damping devices, which damp recoils, or also technical devices for adapting the firearm are received. The adjusting device is to also be suitable for firearms, the rear stock of which is permanently connected to the front part or which can only be released from the front part in a cumbersome manner. The adjusting device is to in particular be easy to use and is to be formed to be cost-efficient as well as reliable.

This object is solved by means of a device according to claim 1. Advantageous embodiments and further developments are specified in the dependent claims.

The invention is characterized in that the first joint part comprises a spherical, in particular ball-shaped, joint head, which is mounted in a corresponding recess of the second joint part, and the fixing apparatus comprises a clamping part, which likewise comprises a recess for receiving the spherical joint head at least in some sections, wherein, in the fixed state, the joint head is clamped between the second joint part and the clamping part by means of the at least one fixing element. The handgun (or portable firearm), in particular long firearm, for example a hunting rifle, comprises a rear stock and a front part connected thereto. In the use position of the firearm, the rear stock is thereby provided for resting on the shoulder of a shooter, and the front part is generally connected directly to a barrel of the firearm. To be able to orient the rear stock, in particular a longitudinal axis of the rear stock, relative to the front part, in particular relative to a longitudinal axis of the front part, a ball joint is arranged between the rear stock and the front part. The ball joint comprises a first and a second joint part, wherein the first joint part is connected in a positionally fixed manner to the front part or the rear stock, while the second joint part is pivotable in relation to the first joint part and is connected in a positionally fixed manner to the other of the front part or of the rear stock. A positionally fixed connection is thereby in particular understood to be a non-pivotable connection. The first joint part and the second joint part are connected to one another by means of a fixing apparatus, which is designed so as to be capable of being transferred at least between a released state and a fixed state. The fixing apparatus is designed to allow a pivoting of the first joint part in relation to the second joint part in the released state, and to prevent a pivoting of the first joint part with respect to the second joint part in the fixed state, thus to fix the two joint parts with respect to one another in their adjusted positions. To release and fix the fixing apparatus, i.e. to transfer the fixing apparatus between the released state and the fixed state, said fixing apparatus comprises at least one fixing element.

In view of the pivoting and fixing of the rear stock in relation to the front part, the ball joint is formed in a particularly reliable and stable manner in that the first joint part comprises a spherical, in particular ball-shaped, joint head, which is mounted in a corresponding recess of the second joint part. The recess of the second joint part is favorably formed for the planar and slidable abutment of a part of the joint head thereon. To be able to fix the joint head and the recess of the second joint part to one another in a positionally fixed manner, the fixing apparatus comprises a clamping part, which likewise comprises a recess for receiving at least sections of the spherical joint head. In the fixed state of the fixing apparatus, the joint head is clamped in a positionally fixed manner between the second joint part and the clamping part by means of the at least one fixing element.

The ball joint thus provides for a pivoting of the longitudinal axis of the rear stock relative to the longitudinal axis of the front part in two spatial dimensions and in a large angular range of, for example, between 0° and 45°, preferably between 0° and 30°, more preferably between 0° and 15°, as well as a rotation around the own axis by 360°. The ball joint and the fixing apparatus are formed in a robust and cost-efficient manner and make it possible that the adjusted positions of rear stock and front part are also reliably maintained during the use of the firearm. It is particularly significant that the adjusting device does not have any components, which extend far into the rear stock or through the rear stock. The adjusting device can thus also be used for firearms, the rear stock of which in particular on the rearward end is unsuitable for receiving components of the adjusting device, or the rear stock of which is to only be modified to the smallest possible extent.

The terms "rear" and "front" used in this disclosure refer to the use position of the firearm. The term rear thus means a position close to the shooter firing the weapon, while the term front describes a position close to a muzzle of the firearm. The terms "top", "bottom", "left", and "right" are to likewise be understood in the use position of the firearm or from the perspective of the shooter firing the weapon, respectively.

According to a preferred embodiment of the invention it is provided that at least one screw, preferably four screws, is or are provided, respectively, as fixing element. The at least one screw thus serves the purpose of optionally releasing and fixing the fixing apparatus, i.e. to transfer the fixing apparatus between the released state and the fixed state. The at least one screw can be formed with a screw head, which is suitable for an engagement of a suitable tool. The screw head is particularly preferably formed for a tool-free actuation of the screw, i.e. an actuation by means of the finger of the shooter. Instead of the screw head, the screw can be provided for this purpose with a wheel, which is to be rotated by hand, or with at least one wing protruding from the screw. If a plurality of screws are provided, which are arranged in a favorably distributed manner, a jamming of the fixing apparatus can be prevented when fixing the latter as well as the expenditure of force necessary for tightening each screw can be reduced due to the force distribution to the plurality of screws.

To be able to release and fix the fixing apparatus particularly easily and reliably, it can be provided that the second joint part comprising the spherical recess and/or the clamping part comprises at least one threaded hole and/or a, preferably stepped, passage opening. The threaded hole and/or passage opening is provided for receiving the fixing element. A screw can thus be screwed into the threaded hole and/or passage opening, or another tension element can be introduced therein, to thus force the second joint part and the clamping part against one another and to thereby press the first joint part in a positionally fixed manner against the second joint part. If the passage opening is formed in a stepped manner, the head of a screw can be countersunk in the second joint part or in the clamping part, whereby injuries to the shooter, which may occur on a protruding fixing element, are avoided.

If an access opening for accessing the threaded hole and/or passage opening provided for receiving the fixing element is arranged on a surface of the clamping part or of the second joint part, which surface faces away from the rear stock, the fixing element can favorably be actuated on the firearm from the front, from the side, from the top or from the bottom and independently of the formation of the rear stock. A modification of the rear stock is thus not required for access to the fixing element. The access opening can in particular be formed as extension of the threaded hole and/or passage opening, to be able to engage with the fixing element through the access opening, for example by means of a tool.

For the pivoting or orientation, respectively, of the rear stock in relation to the front part of the firearm, it is particularly favorable when the joint head is arranged in a rear section of the front part, in particular in a handle section. Essentially the entire front part can be pivoted in the same direction relative to the rear stock in this way. In addition, the rear section of the front part, in particular the handle section, generally provides sufficient room for the arrangement of the joint head.

For the pivoting or orientation, respectively, of the rear stock in relation to the front part of the firearm, it is additionally favorable when the joint head is arranged in front of a front end face of the rear stock, the front end face facing the front part. The rotation point of the adjusting device lies outside of the rear stock in this way, so that no complex changes for receiving the joint head in the rear stock are thus required on said rear stock.

To fasten the ball joint to the firearm, it can be provided that the joint head is connected to the rear stock by means of a mounting rod protruding from said joint head. Only one opening for receiving the mounting rod is thus required in the rear stock. The joint head and the rear stock can be connected to one another in a releasable or non-releasable manner. The mounting rod and the opening in the rear stock can comprise, for example, a thread for screwing the mounting rod into the opening. The distance of the joint head and thus the rotation point of the adjusting device can additionally be specified in a suitable manner by means of the length of the section of the mounting rod which section protrudes from the front end face of the rear stock. The mounting rod additionally offers the advantage that it provides for a large pivot angle of the ball joint.

It is likewise favorable when the joint part comprising the recess for receiving the joint head is connected to the front part. The joint part comprising the recess, i.e. the second joint part, can in particular be arranged in a rear section of the front part, in particular in a handle section. The front part, in particular its rear section or the handle section, respectively, generally offers sufficient room for at least partially receiving the second joint part. It goes without saying that the second joint part can also be mounted to an outer surface of the front part.

To be able to clamp the joint head easily and reliably between the second joint part and the clamping part, it can be provided that the clamping part comprises a passage opening for receiving the mounting rod. The clamping part is thus arranged around the mounting rod and can abut on the side of the joint head facing the rear stock/front part, while the second joint part abuts on the side of the joint head facing the front part/rear stock. The passage opening is favorably arranged in the center of the clamping part, so as to symmetrically exert the force of the clamping part on the joint head when fixing the fixing apparatus.

BRIEF DESCRIPTION OF THE FIGURES

The invention will be described in more detail below on the basis of preferred exemplary embodiment, to which the invention shall not be limited, however. In the drawings.

DETAILED DESCRIPTION

Figures 1, 2, 3:
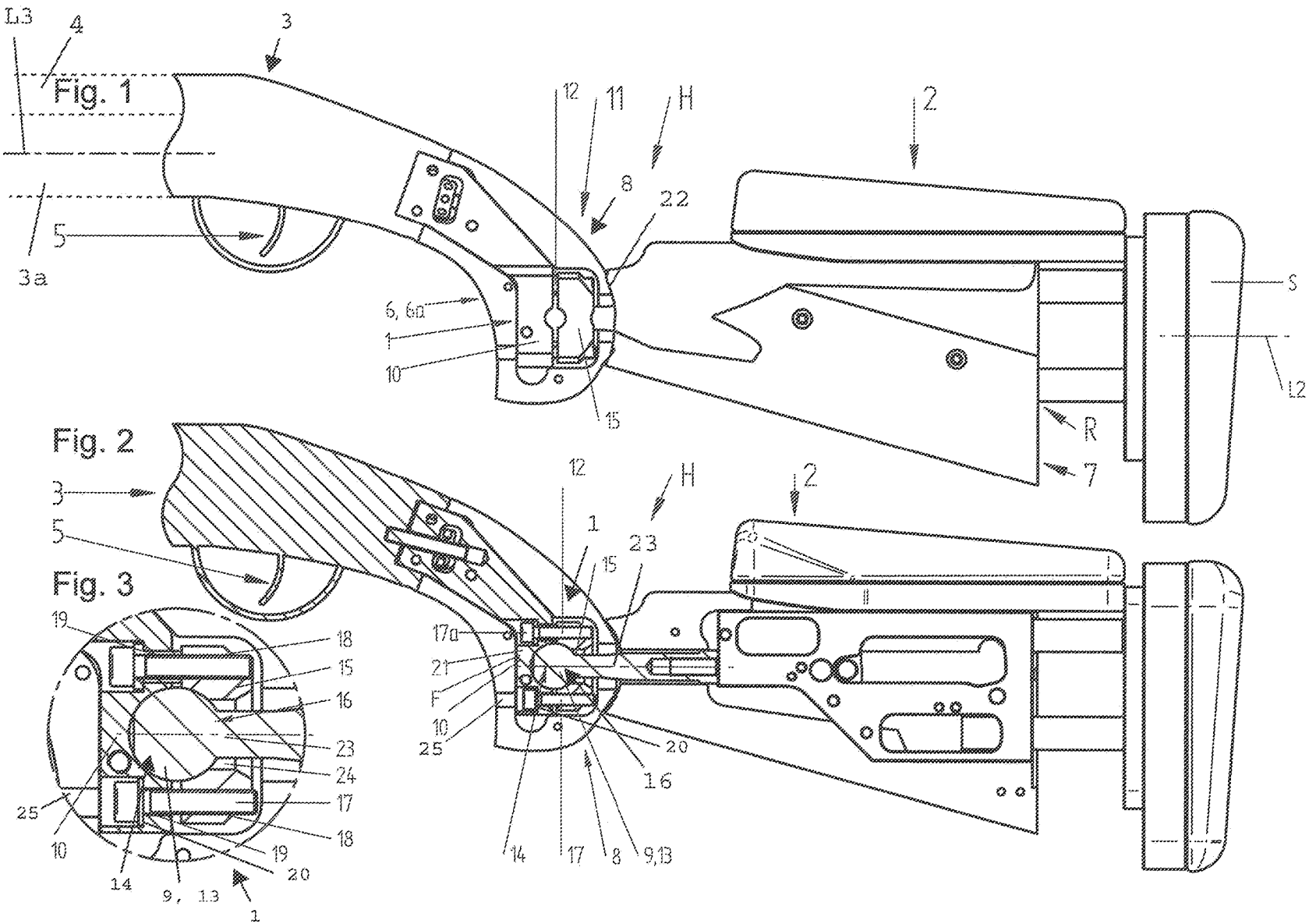
FIG. 1 shows a side view onto a handgun comprising a front part, which is only partially illustrated, and a rear stock, comprising an adjusting device according to the invention.
FIG. 2 shows the side view onto the handgun from FIG. 1 in a longitudinal section.
FIG. 3 shows a detail view of the adjusting device from FIG. 1.

FIG. 1 shows a rear part of a handgun H, in particular of a long firearm, for example of a hunting rifle, comprising an adjusting device 1, a rear stock 2 provided for resting on the shoulder of a non-illustrated shooter, and comprising an only partially illustrated front part 3. The front part 3 comprises a front stock 3*a*, as well as a barrel 4, wherein the barrel 4 on the top side of the front stock 3*a* and a trigger 5 on the bottom side of the front stock 3*a* are only suggested by broken lines. The front part 3 additionally comprises a rear section 6, in particular a handle section 6*a*, which is arranged opposite to a non-illustrated muzzle of the barrel 4. According to the shown exemplary embodiment, the rear stock 2 can be formed with a recoil-damping device R, which is in particular arranged in a middle and rearward section 7 of the rear stock 2. The recoil-damping device R is formed to transfer the recoil of the handgun H occurring as a result of firing a shot in a cushioned manner to a shoulder support S, which is provided for resting on the shoulder of the shooter. The recoil-damping device R itself is not part of the invention and is illustrated in the shown exemplary embodiment as suitable example for components, which take up a majority of the volume of the rear stock 2. To adjust the orientation of the rear stock 2 relative to the barrel 4 or relative to the front part 3 of the handgun H, respectively, a ball joint 8 is arranged between the rear stock 2 and the front part 3. The ball joint 8 provides in particular for an adjustment of an angle between a longitudinal axis L2 of the rear stock 2 and a longitudinal axis L3 of the front part 3 in two spatial dimensions, i.e. to the top, bottom, left and right.

The ball joint 8 comprises a first joint part 9 connected in a positionally fixed manner to the rear stock 2, and a second joint part 10, which can be pivoted relative to the first joint part and which is connected in a positionally fixed manner to the front part 3. The two joint parts 9, 10 are thus mounted so as to be pivotable with respect to one another and so as to be rotatable around the own axis. In an equal, non-illustrated embodiment, the ball joint 8 could comprise a first joint part 9, which is connected in a positionally fixed manner to the front part 3, and a second joint part 10, which can be pivoted relative to the first joint part and which is connected in a positionally fixed manner to the rear stock 2, for which case the following explanations by a person of skill in the art can be transferred in a simple way from the illustrated embodiment to the equal, non-illustrated embodiment.

The first joint part 9 and the second joint part 10 are connected to one another by means of a fixing apparatus 11. The two joint parts 9, 10 can be pivoted with respect to one another in a released state of the fixing apparatus 11 by means of the fixing apparatus 11, and are fixed with respect to one another in their adjusted positions in a fixed state of the fixing apparatus 11. To be able to release and fix the fixing apparatus 11, the fixing apparatus 11 comprises at least one fixing element 12.

FIG. 2 shows a side view onto a longitudinal section through the handgun H, and FIG. 3 shows the adjusting device 1 from FIG. 2, in longitudinal section, in an enlarged scale. It can be seen therein that the first joint part 9 comprises a spherical, in particular ball-shaped, joint head 13, which is mounted in a corresponding recess 14 of the second joint part 10. To be able to fix the two joint parts 9, 10 to one another in the adjusted position or orientation, respectively, the fixing apparatus 11 comprises a clamping part 15, which likewise comprises a recess 16 for receiving at least sections of the spherical joint head 13. The joint head 13 can thus be fixedly clamped between the second joint part 10 and the clamping part 15 by means of the at least one fixing element 12 in the fixed state of the fixing apparatus 11. In contrast, the joint head 13 and the second joint part 10 can be pivoted in relation to one another in the released state of the fixing apparatus 11.

The fixing element 12 for releasing and fixing the fixing apparatus 11 can be at least one screw 17, in the present example two or four screws 17. To receive the fixing element 12, in particular screws 17, the second joint part 10 and/or the clamping part 15 can comprise at least one threaded hole 18 and/or a passage opening 19, which is preferably provided with a step 20 for receiving a screw head 17*a*. The second joint part 10 and the clamping part 15 can thus be forced against one another, in order to clamp the joint head 13 between them, by means of the fixing element 12, which is received in the threaded hole 18 and/or passage opening 19.

To access the threaded hole 18 and/or passage opening 19, for example to access a screw head 17*a*, an access opening 25 can be arranged on a surface F of the clamping part 15 or of the second joint part 10 which surface F faces away from the rear stock 2. That surface or that area, respectively, which has a normal thereon, which does not intersect the rear stock 2 in all adjustable orientations between the rear stock 2 and the front part 3 and in a direction away from the clamping part 15 or from the second joint part 10, can preferably be understood as the surface F, which faces away from the rear stock 2. In the illustrated exemplary embodiments, the access opening 25 is provided on the front side 21 of the second joint part 10.

For a suitable orientation of the rear stock 2 relative to the front part 3, it is favorable when the joint head 13 is arranged in the rear section 6 of the front part 3, in particular in the handle section 6*a*, and in front of a front end face 22 of the rear stock 2 which front end face 22 faces the front part 3. The joint head 13 can be connected, for example, to the rear stock 2 by means of a mounting rod 23 protruding from said joint head, and the second joint part 10 comprising the recess 14 for receiving the joint head 13 can be connected to the front part 2 or can be integrated therein. The clamping part 15 is favorably provided with a passage opening 24 for receiving the mounting rod 23, i.e. the clamping part 15 is slid onto the mounting rod 23.

The adjusting device 1 thus provides for a reliable orientation and fixation of the rear stock 2 in relation to the front part 3, by means of a ball joint 8 and a fixing apparatus 11, for the purpose of which only one fastening apparatus, for example a hole for receiving a mounting rod 23, is to be provided on the rear stock 2 for connection to the ball joint 8. The adjusting device 1 favorably does not have any components, which pass through the rear stock 2.

The invention claimed is:

1. A device for adjusting the orientation of a rear stock of a handgun relative to a barrel of the handgun, comprising a ball joint, which is arranged between the rear stock and a front part fixedly connected to the barrel which ball joint comprises a first joint part connected in a positionally fixed manner to the front part or the rear stock, and a second joint part, which can be pivoted relative to the first joint part and which is connected in a positionally fixed manner to the other of the rear stock or the front part, wherein the first joint part and the second joint part are connected to one another by means of a fixing apparatus so as to be pivotable with respect to one another in a released state of the fixing apparatus, and so as to be fixed with respect to one another in their adjusted positions in a fixed state of the fixing apparatus, and the fixing apparatus comprises at least one fixing element for releasing and fixing the fixing apparatus, wherein the first joint part comprises a spherical, in particular ball-shaped, joint head, which is mounted in a corresponding spherical recess of the second joint part, and the fixing apparatus comprises a clamping part, which likewise comprises a recess for receiving the spherical joint head at least in some sections, wherein, in the fixed state, the joint head is clamped between the second joint part and the clamping part by means of the at least one fixing element, wherein the second joint part comprising the spherical recess or the clamping part comprises a threaded hole and/or a passage opening, and the other of the second joint part or the clamping part comprises a passage opening and an access opening, the access opening being provided for accessing the passage opening and the threaded hole provided for receiving the fixing element, wherein the access opening is arranged on a surface of the clamping part or of the second joint part, which surface faces away from the rear stock.

2. The device according to claim 1, wherein at least one screw is provided, as the fixing element.

3. The device according to one of claim 2, wherein joint head is arranged in a rear section of the front part, in particular in a handle section.

4. The device of claim 2 wherein four screws are provided.

5. The device according to claim 3, wherein the joint head is arranged in front of a front end face of the rear stock which front end face faces the front part.

6. The device according to claim 5, wherein the joint head is connected to the rear stock by means of a mounting rod protruding from said joint head.

7. The device according to claim 6, wherein the joint part comprising the recess for receiving the joint head is connected to the front part.

8. The device according to claim 7, wherein the clamping part comprises a passage opening for receiving the mounting rod.

9. The device of claim 1 wherein the device is a long firearm.

* * * * *